US005365217A

United States Patent [19]

Toner

[11] Patent Number: 5,365,217

[45] Date of Patent: Nov. 15, 1994

[54] PERSONAL SECURITY SYSTEM APPARATUS AND METHOD

[75] Inventor: Frank J. Toner, Box J 210 N. Benson Ave., Longport, N.J. 08402

[73] Assignees: Frank J. Toner; Atlantic Coast Alarm, Margate, N.J.

[21] Appl. No.: 839,343

[22] Filed: Feb. 20, 1992

[51] Int. Cl.[5] ..... G08B 1/08

[52] U.S. Cl. ..... 340/539; 340/531; 455/38.2

[58] Field of Search ..... 340/539, 531, 573; 11/11; 455/38.2

[56] References Cited

U.S. PATENT DOCUMENTS 3,848,231 11/1974 Wootton ..... 340/539
3,914,692 10/1975 Seaborn, Jr. ..... 340/539
3,925,763 12/1975 Wadhwani et al. ..... 340/539
4,396,910 8/1983 Enemark et al. ..... 340/539
4,468,656 8/1984 Clifford et al. ..... 340/539
4,611,198 9/1986 Levinson et al. ..... 340/531
4,670,739 6/1987 Kelly, Jr. ..... 340/539
4,952,928 8/1990 Carroll et al. ..... 340/539

*Primary Examiner*—Donnie L. Crosland

[57] ABSTRACT

A method and apparatus for monitoring safety of persons within a predetermined area includes personal transmitters for wirelessly transmitting distress signals, stations for detecting transmission of any such distress signals and generating relay signals indicative of the transmitter of the distress signal for receipt by a central monitoring station for processing thereby.

36 Claims, 7 Drawing Sheets

```
Status: Self Test Date: 11-03-92  Time: 20:00:00
Test ended 11-03-92 20:04:51
System fully functional
==================================================
ALARM  Date: 11-03-92       Time: 22:30:45  ALARM
id= 12345  Tower = 86
Smith, Jane; Faculty; Diabetic
Acknowledge: Dave Jones     Time: 22:31:34
==================================================
```

*FIG. 12*

PERSONAL SECURITY SYSTEM APPARATUS AND METHOD

BACKGROUND OF THE INVENTION

1. Field of the Invention

This invention relates to methods and apparatus for providing security for personnel freely moving about within a predetermined area.

2. Description of the Prior Art

With increasing levels of crime and violence in society, the problem of providing safety and security for persons freely moving about within a predetermined area has become more and more acute. Universities, hotels, industrial plants and the like have an overriding interest in providing a safe environment and a feeling of high personal safety for persons within the predetermined area defined by the university campus, hotel premises, industrial plant setting and the like.

Heretofore, persons for which a given institution, such as a university, hotel or industrial plant, desired to assure personal safety have been provided with "beeper" devices to emit alarm tones upon actuation by a person carrying such a beeper device. In such systems, the individual actuating the beeper device, to inform others that the person is in apprehension respecting his or her personal safety, depends on the goodwill and cooperation of others (who are in the local area and hear the audible "beeper" alarm) to assist the individual actuating the beeper.

Other approaches have included television monitoring cameras and the like distributed about the predetermined area. In such systems video signals are transmitted, usually via wires, to a central relay station at which security personnel continuously watch video screens displaying the video signals.

In some instances, where continuous surveillance is required, a single video screen is provided for each video camera located throughout the predetermined area of interest. In other situations, where the predetermined area may be exceedingly large or the number of security personnel available to monitor the screens is limited, the number of video display screens is fewer than the number of video cameras. In such case, multiplexing means is provided for switching, on a rotating basis, connections between single video monitors and the plurality of video cameras spread throughout the predetermined area.

Use of the video camera approach is effective to a point, but is notably deficient at night and at any time respecting interior security. Specifically, it is often economically impossible to place a video camera at positions whereby every locale within every building in the predetermined area can be monitored on a continuous basis.

As yet another disadvantage of the video camera approach, whether used indoors or out of doors, such systems are silent and passive. The persons whose safety is being protected are not active participants in the security monitoring system; the individuals do not actuate devices to emit alarms and thereby signal their distressed state. The passive nature of the system does not provide the protected individuals with a secure feeling such as experienced when the individual is an active participant in maintaining his or her safety and carries a device which, when activated, triggers an alarm which is audible to and/or visible by the person being protected.

SUMMARY OF THE INVENTION

In one of its aspects, this invention provides apparatus for monitoring safety of a dynamically changing plurality of preselected persons within a predetermined area. The apparatus preferably includes a plurality of personal distress signal transmitters for wirelessly transmitting distress signals. The distress signals include information corresponding to a unique identification code for the user of each personal distress signal transmitter. The unique identification codes are assigned to the users when they are accepted as men, pets of the plurality of persons whose safety is to be monitored.

Each of the personal distress signal transmitters preferably includes a memory for storing information corresponding to a selected one of the unique identification codes for that particular user. The portable personal distress signal transmitters also include a manual switch for activating the transmitter and thereby transmitting a continuous distress signal including information corresponding to a selected unique identification code for the custodian of that transmitter, for which information corresponding to the unique code is stored in programmable read-only memory of the transmitter.

The personal portable distress signal transmitter further preferably includes a battery for power and yet further preferably includes circuitry for detecting when the battery is approaching an unacceptably low level and providing an alarm signal indicative of low battery-charge level. Optionally, the personal distress signal transmitter may include an alarm, visible and/or audible to the user of the personal distress signal transmitter, for indicating an unacceptably low battery charge level. Additionally or alternatively the personal distress signal transmitter may transmit a battery charge indicator signal to a relay station with the signal being indicative of battery charge approaching or being at an unacceptably low level.

The apparatus further includes a plurality of stations for continuously detecting distress signals from any of the portable personal distress signal transmitters. These detecting stations, upon detecting a distress signal from any of the personal portable signal transmitters, transmit a relay signal including information corresponding to the unique identification code associated with the portable personal distress signal transmitter from which the distress signal has been received. The detecting stations, upon transmitting the relay signals, may include with such relay signals information identifying the specific one(s) of said detecting stations among said plurality which is transmitting the relay signal.

The apparatus yet further includes a central monitoring station for receiving the relay signal(s) and providing a visible display of the location of the detecting station(s) transmitting the relay signal(s). The central monitoring station further includes apparatus for determining whether the unique identification code, for which the information was received as a part of the relay signal(s) generated in response to a distress signal, is a code for a person currently a member of the preselected plurality of personnel whose security is to be monitored.

Further encompassed within the apparatus aspect of the invention is a programmable device, preferably a personal computer, for maintaining and dynamically updating a list of the plurality of persons and the identification codes uniquely associated with those persons. This information is used by the central monitoring station in determining whether a given identification code, for which a relay signal has been received, is for a person currently a member of the preselected plurality of persons whose safety is to be monitored.

In another of its aspects, this invention provides a method for monitoring safety of a plurality of persons within a predetermined area. The method includes wirelessly transmitting a distress signal indicative of a preselected code unique to a person of the plurality upon that person being in apprehension respecting his or her personal safety.

The method further encompasses continuously detecting transmission(s) of any distress signal(s) at a plurality of stations distributed throughout the predetermined area within which safety of the plurality of persons is to be monitored.

The detecting stations are distributed throughout the predetermined area in a manner that at least one of the stations is within transmitting range of the portable personal distress signal transmitter for all territory within the predetermined area. The method further encompasses sending a relay signal(s) to a central monitoring station from the station(s) detecting the distress signal. The relay signal includes information indicative of the unique code included in the distress signal and information indicative of the detecting station location(s) within the predetermined area from which the relay signal is sent.

The method yet further encompasses detecting the relay signal at a central monitoring station and correlating the unique code with an individual of the plurality. The method still yet further encompasses correlating the information indicative of the location from which the relay signal(s) was sent with position(s) within the predetermined area and providing a sensorially perceptible display of the identity of the individual and location(s) within the predetermined area from which the distress signal, containing information associated with the unique code for the identified individual, was transmitted.

BRIEF DESCRIPTION OF THE DRAWINGS

FIG. 12 is a schematic representation of information generated by the central monitoring station for a given distress signal.

Figure 1:
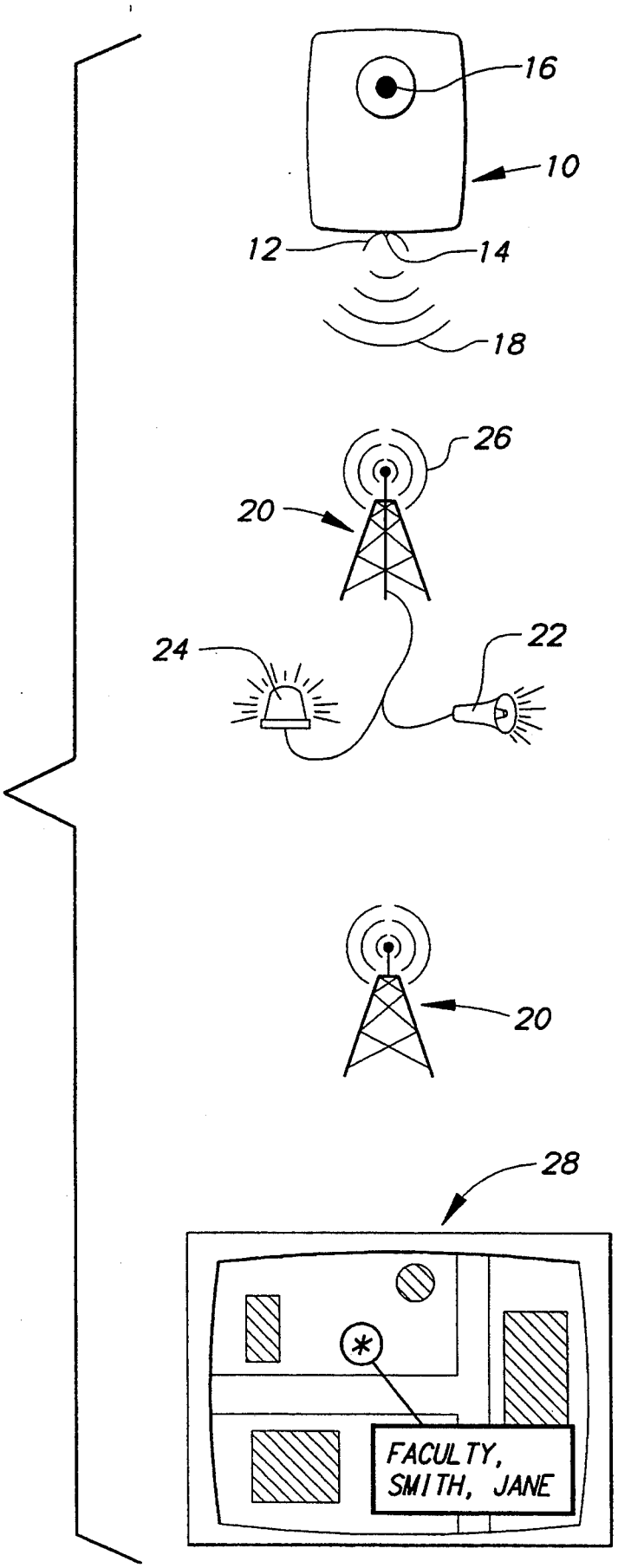
FIG. 1 is a schematic illustration depicting apparatus and methods for monitoring safety of a dynamically changing plurality of preselected personnel within a predetermined area, manifesting aspects of the invention.

Reference numerals in the drawings correspond to reference numerals in the following text describing the apparatus and method aspects of this invention. In the drawings, prime notation denotes components corresponding in function to components having similar identification numbers but lacking such prime notation.

DESCRIPTION OF THE PREFERRED EMBODIMENTS AND BEST MODE KNOWN FOR PRACTICING THE INVENTION

FIG. 1 schematically depicts apparatus and methods for monitoring safety of a dynamically changing plurality of preselected personnel within a predetermined area. The apparatus includes a plurality of portable personal distress signal transmitters, one of which has been designated generally 10 in FIG. 1.

Portable personal distress signal transmitter 10 is preferably hung as a pendant, using a chain 12, about the neck of a member of the plurality of preselected personnel whose safety is to be monitored. Chain 12 preferably fits through an eye 14 affixed to the case of portable personal distress signal transmitter 10. Transmitter 10 preferably includes a manual actuator button or switch 16 which the person having transmitter 10 in his or her custody can actuate upon coming in apprehension of his or her personal safety. Upon actuating button 16, signal transmitter 10 sends out a personal distress signal indicated schematically 18 in FIG. 1.

The personal distress signal includes an identification code. The code typically is at least 20 bits of information identifying the unique code associated with the current custodian of the portable personal distress signal transmitter 10. Use of a 20 bit identification code permits about one million different transmitter codes to be used in the system. However, usually only 50,000 or fewer codes will be in active use at any time.

Portable personal distress signal transmitter 10 preferably uses pulse position modulation technology to transmit the code information making up the personal distress signal.

The apparatus further includes a plurality of station means for detecting distress signals emitted by portable personal distress signal transmitters 10 . While a plurality of detector stations means are provided, only two such detector stations 20 are illustrated in FIG. 1 to enhance drawing clarity.

Each portable personal distress signal transmitter 10 includes means for storing information corresponding to a unique identification code associated with the custodian of the particular portable personal distress signal transmitter. When the personal distress signal transmitter 10 is actuated, by pressing actuator button 16, transmitter 10 transmits a distress signal which includes the stored information corresponding to the unique identification code of the person using the personal distress signal transmitter. The distress signal is preferably substantially in the 300 megahertz band and is preferably amplitude modulated to provide information associated with the identification code which is unique to the custodian of the personal distress signal transmitter.

The personal distress signal transmitter 10 need have only a fairly limited memory capacity. Typically, up to one million unique codes can be generated for persons within the preselected plurality and one of such codes can be programmed into the personal distress signal transmitter 10.

Optionally, the signal transmitter 10 can be programmed to periodically send a discreet identity code so that position of a given personal signal transmitter 10 within the predetermined area can be determined at any time. Such a transmitter, having such optional capability, may be used by security guards and the like, so that their location can be tracked to facilitate response to a distress signal.

The type of transmitter envisioned for use as the portable personal distress signal transmitter 10 has been approved under FCC rules, part 15, subpart E, as a control and security alarm device and requires no site licensing.

Each portable personal distress signal transmitter preferably further includes a battery for powering the portable personal distress signal transmitter. Optionally, there may be provided within the personal distress signal transmitter a device for detecting when the battery is approaching an unacceptably low level of charge and providing an alarm signal indicative of the battery approaching this unacceptably low level.

The alarm signal indicative of low level of battery charge may be an audible signal provided only to the custodian of the personal distress signal transmitter. Alternatively, the alarm signal indicative of low battery charge level may be an information signal transmitted by the distress signal transmitter for detection by one of the distress signal detecting stations, so the custodian of the personal distress signal transmitter can be notified of the battery approaching an unacceptably low charge level. As yet a further alternative, the alarm signal indicative of the battery approaching an unacceptably low charge level may provide a visual indication, in the nature of a flashing light, color change or the like, to the custodian of the personal distress signal transmitter.

Still referring to FIG. 1, each distress signal detecting station 20 may have associated therewith some means, such as a horn, for providing an audible signal to persons in the immediate vicinity upon detecting a personal distress signal. A horn 22 has been illustrated in FIG. 1 to denote means for providing an audible alarm within the vicinity of the distress signal detecting station 20. Preferably, one horn is provided for each distress signal detecting station 20.

Also preferably provided as a portion of each distress signal detector station 20 is light represented schematically 24 in FIG. 1. Light 24 may be a strobe, lighting rapidly and intermittently once distress signal detecting station 20 has detected a personal distress signal. Preferably, light 24 provides sufficient candle power to illuminate the area around associated distress signal detecting station 20.

Each distress signal detecting station 20 includes not only means for detecting transmission of any personal distress signal(s) by any personal portable distress signal transmitter(s) 10 within transmitting range of a detecting station 20, but also includes means for generating and transmitting a relay signal from distress signal detecting station 20 to a central monitoring station. The relay signal, indicated schematically 26 in FIG. 1, includes information corresponding to the unique identification code associated with the custodian of the portable personal distress signal transmitter from which a distress signal has been detected and received. The relay signal also includes information identifying the specific personal distress signal detecting station(s) transmitting the relay signal(s) from among the plurality of distress signal detecting stations scattered over the predetermined area.

Preferably, the relay signal emitted by distress signal detecting station 20 is a separate, high-power radio frequency signal. The format of data sent with the desirably separate, high-power radio frequency signal is preferably sufficiently flexible to permit future expansion, for other types of information to be sent to (or received from) central monitoring station 28.

Each distress signal detecting station 20 preferably includes a receiver for detecting a distress signal transmitted by a personal distress signal transmitter, a transmitter for generating and transmitting a relay signal including information associated with the unique identification code for the custodian of the transmitter from which the personal distress signal was received, a control unit, a transceiver, a power supply for these units and, optionally, a back-up battery. Further optionally the distress signal detector station 20 may include a speaker for providing voice output and even a dedicated land line modem for data transmission back and forth between distress signal detector station 20 and a central monitoring station.

Preferably, the receiver portion of the distress signal detecting station 20 includes a receiver of super-hetrodyne design having a sensitivity of −105 decibels. Such sensitivity is sufficient to provide distress signal detector station 20 a minimum range of 150 feet for receipt of distress signals. Further preferably each distress signal detector station 20 includes a dedicated microcontroller for decoding information encoded in the distress signal.

Preferably, the super-hetrodyne receiver portion of distress signal detector station 20 has a narrow bandwidth, increasing signal to noise ratio. Receiver input is preferably connected to an F-type RF connector, allowing an antenna portion of the distress signal detector station 20 to be mounted separately.

Each distress signal detector station 20 further preferably includes an associated distress signal transmitter having attenuated output. This provides for complete loop-back self-testing of each distress signal detector station 20 as desired, responsively to test signals initiated by the central monitoring station.

A control unit in each distress signal detector station 20 performs radio reception of the distress signals, manipulates codes received as a portion of the distress signal and retransmits such codes, together with unique identification codes for the given distress signal detector station 20, to a central monitoring station. The control unit also preferably performs self-test and battery supervision functions. Yet additionally, the control unit monitors a tamper switch provided for enclosure security of the distress signal detector station 20.

Further preferably provided as a portion of the control unit is an accessory relay switch for actuation of external enunciator equipment such as lights and speakers 24, 22 as illustrated schematically in FIG. 1. Typically, such accessory relay may provide 12 volts of DC power and be protected by a self-recovering fuse. The control unit further preferably includes a test/operation switch to facilitate installation and maintenance of the particular distress signal detector station 20.

Each control unit of a given distress signal detector station 20 preferably contains a microcontroller having both a fixed memory as an EPROM and a programmable memory as an EEPROM. The fixed memory desirably contains power up, communication, system security and other instructional software routines, including a routine to securely receive and store additional functions and commands in the programmable memory. This capability permits distress signal detector station 20 to change function as experience and necessity dictate without the necessity of removing or replacing all of the equipment.

Each distress signal detector 20 further preferably includes a transceiver unit permitting the control unit to communicate reliably with a central monitoring station. The transceiver contains a transmitter and a receiver allowing bidirectional communication between distress signal detecting station 20 and a central monitoring station. The transmitter portion of the transceiver of distress signal detecting station 20 preferably has a power output of from 1 to 5 watts. This can vary depending upon site requirements. Such a radio link may require an FCC site license. The transceiver is preferably connected to an external antenna through 50 ohm coaxial cable and a BNC or F-type RF connector.

In lieu of the transceiver portion of the distress signal detecting station 20, a dedicated land line modem may be used. Use of the modem in lieu of the radio link affects only the method used to communicate between the distress signal detecting station 20 and the central monitoring station; the information transferred between the distress signal detecting station 20 and the central monitoring station is not affected.

Power may be supplied to the distress signal detecting station 20 either from a 120 or 220 volt alternating current supply or from a solar panel. Appropriate circuitry in the distress signal detecting station 20 provides power conditioning, battery charging and low battery power sensing.

Figure 6:
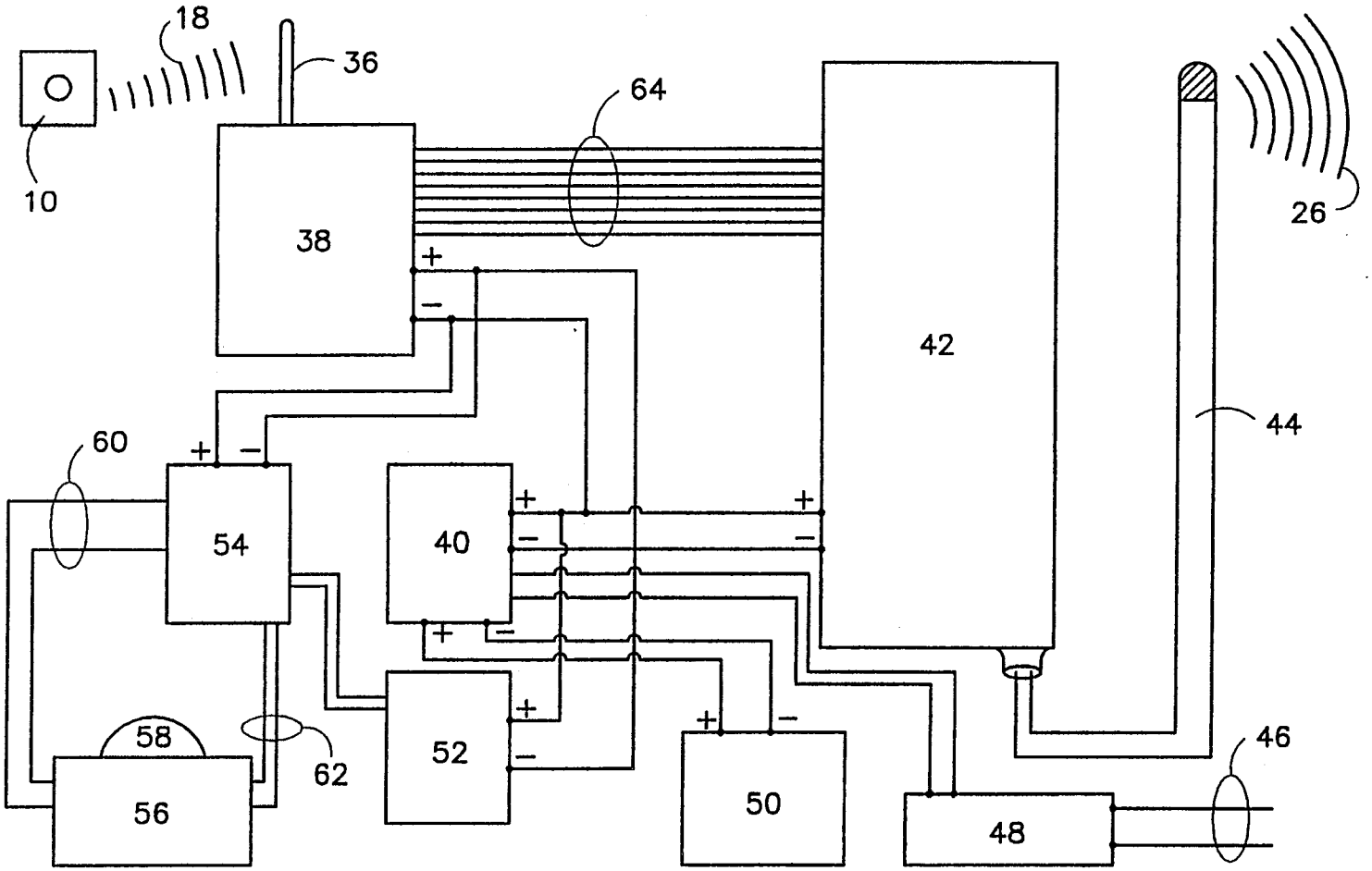
FIG. 6 is a schematic diagram principally of a distress signal detector station portion of the invention.

Referring to FIG. 6, the distress signal detecting station 20 is shown in greater schematic detail. A personal signal distress transmitter 10 is illustrated schematically as providing a signal illustrated schematically and designated 18 which is picked up by an antenna 36 of distress signal detector station 20. Signal 18 transmitted by distress signal transmitter 10 is typically transmitted in the 315 megahertz band, for example at about 303.875 megahertz.

Signal 18 is received by antenna 36 connected to a receiver designated generally 38. One suitable unit for use as receiver 38 is a D-4R series, AC-800 receiver available from Linear Corporation.

Distress signal detector station 20 further includes a power supply 40. One unit suitable for use as power supply 40 is an Altronix 6/12 power supply.

Distress signal detector station 20 yet further preferably includes a transmitter 42 for sending a relay signal 26 to a central monitoring station. Suitable units for use as transmitter 42 are available from Linear Corporation under the model designations MR161T, MR164T and MR168T. Transmitter 42 transmits signal 26 via antenna 44.

Power to distress signal detector station 20 is preferably provided via lines 46 connected to 110 volt alternating current. A transformer 48 is provided for stepping down the 110 volt AC power provided via lines 46 to preferably 16 volt AC power.

Distress signal detector station 20 further preferably includes a stand-by battery 50 which may typically be a 12 volt DC battery. Distress signal detector station 20 further preferably includes a relay timer 52. One unit suitable for use as relay timer 52 is available from Altronics as model 6060. Relay timer 52 provides output to a voice/siren driver 54. One suitable unit for use as voice/siren driver 54 is available from Ademco under the model designation 745. Voice/siren driver 54 preferably provides both an output signal for an audio speaker 56 and an alarm strobe 58 associated with speaker 56. Typically, the speaker output may be provided from voice/siren driver 54 via lines 60 while the strobe light may be powered via lines 62.

In one exemplary practice of the invention, power supply 40 receives 16 volts AC from transformer 48 and converts this 16 volt AC signal into a 12 volt DC signal. The 12 volt DC signal is then provided as output power for use by receiver 38, transmitter 42, relay timer 52 and voice/siren driver 54. These connections have been illustrated in FIG. 6 but have not been numbered to ensure drawing clarity.

Outputs from receiver 38 are provided via relay lines 64 as input to transmitter 42. Receiver 38, power supply 40, transmitter 42, transformer 48, and relay timer 52, together with their associated antennas, power lines, connecting lines, voice/siren driver, speaker and strobe, define a transceiver constituting one preferred embodiment of a distress signal detector station 20.

The apparatus illustrated schematically in FIG. 1 further includes a central monitoring station represented schematically as 28 for receiving any relay signal(s) from the distress signal detecting station(s). Central monitoring station 28 includes means, preferably in the form of a video display terminal, for providing sensorially perceptible information including location of the detecting station(s) transmitting the relay signal(s). Central monitoring station 28 further includes means for determining whether the identification code (for which information was received from distress signal detecting station 20 and for which information was originally generated by a personal distress signal transmitter 10) is for a current member of the plurality of persons whose safety is to be monitored within the predetermined area. The video monitor or display terminal is depicted in FIG. 1 as constituting a major portion of central monitoring station 28.

Central monitoring station 28 includes a transceiver, a land line modem, a display, a computer and a printer. The transceiver and modem are desirably identical in function to those described above in connection with distress signal detecting station 20.

The computer preferably consists of an IBM-compatible personal computer with a large hard drive storage and high-resolution display monitor.

In FIG. 1, distress signal detector stations 20 have been depicted as sending relay signal(s) 26 wirelessly;

however, these signals could be transmitted via wires if necessary.

Preferably, the personal distress signals and the relay signals are sent at different frequencies.

When central monitoring station 28 receives a relay signal, it initially determines whether only one or more than one relay signal is being received. If only a single relay signal is being received, central monitoring station 28 identifies the location from which the relay signal was sent. This may be done using information identifying the particular sending station 20 and encoded as a part of the relay signal. Alternatively, a unique relay signal, for example unique in frequency, can be sent by each distress signal detector station 20.

If central monitoring station 28 determines that more than one relay signal has been received and that the relay signals have been triggered as a result of detecting a single personal distress signal, central monitoring station 28 may compute, using triangulation techniques, the location from which the personal distress signal was transmitted to cause the relay signals to be sent.

If the portable personal distress signal transmitters 10 are equipped to provide and transmit a signal indicative of low battery power and consequent risk of a low power or no distress signal, distress signal detector stations 20 may continuously monitor to detect any transmission(s) of any such low battery power indicator signal(s) by a personal distress signal transmitter 10. Upon detecting transmission of a low battery power indicator signal, the distress signal detector station 20 detecting such a signal sends an informative signal to central monitoring station 28 where the informative signal is indicative of the unique code associated with the personal distress signal transmitter 10 providing the low battery power signal.

Figure 7:
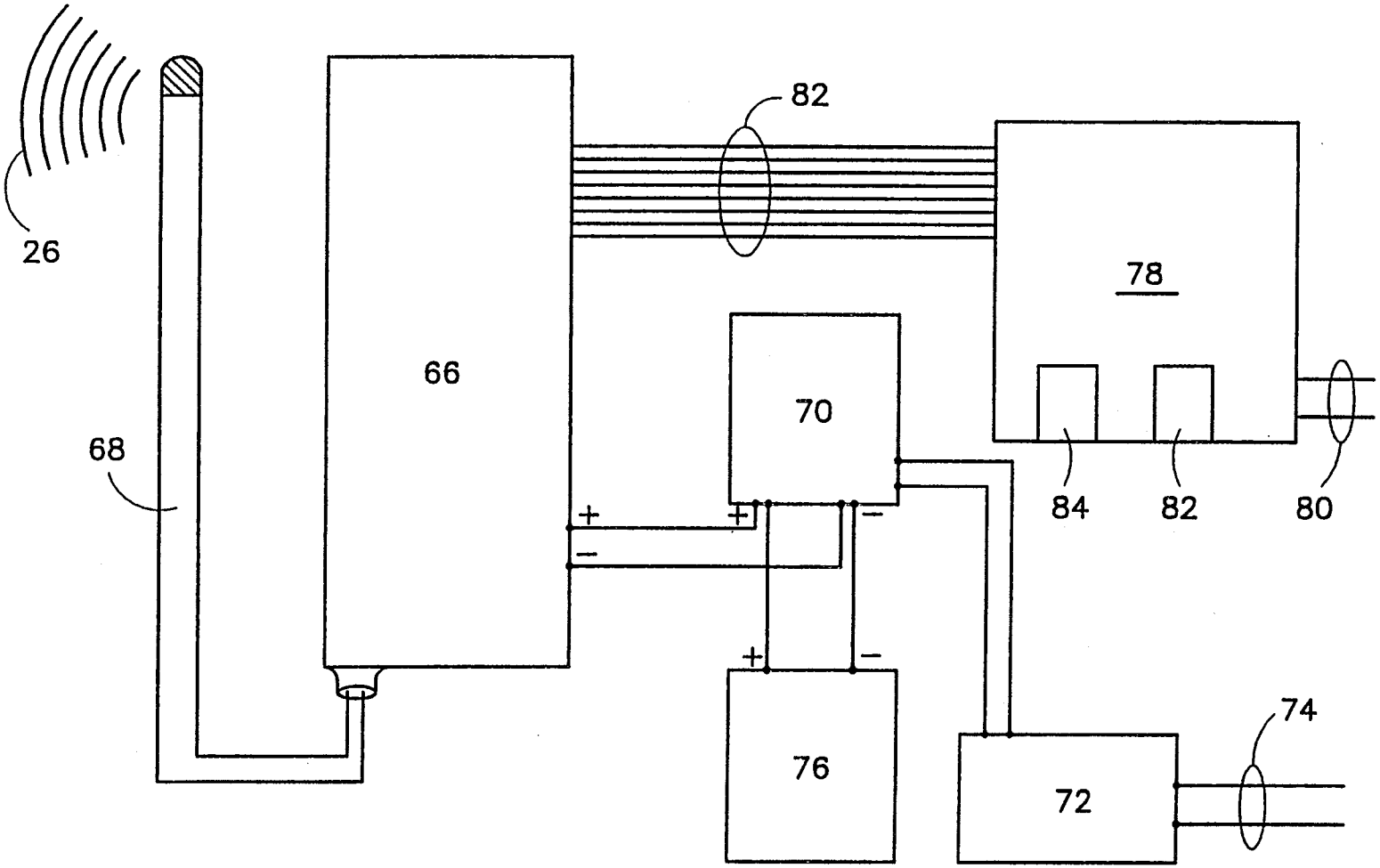
FIG. 7 is a schematic diagram principally of a central monitoring station portion of the invention.

A preferred embodiment of central monitoring station 28 is illustrated schematically in FIG. 7 and includes a receiver 66 having connected thereto an antenna 68 for receiving a relay signal depicted schematically as 26. One unit commercially available and suitable for use as receiver 36 is supplied by Linear Corporation under the model designations MR161R, MR164R and MR168R. Receiver 66 preferably receives signals in the vicinity of 27.145 megahertz.

Central monitoring station 28 further preferably includes a power supply 70, a transformer 72 receiving 110 volt 60 cycle line power via power lines 74. Central monitoring station 28 further preferably includes a 12 volt stand-by battery 76 and a command processor control system designated generally 78 in FIG. 7.

Transformer 72 preferably steps down the 110 volt alternating current to 16 volts AC for input to the power system which may desirably be an Altronix 6/12 power supply. Power supply 70 supplies power to receiver 66.

Command processor control 78 receives power from suitable public utility service 110 volt alternating current power lines designated 80 in FIG. 7. Relay outputs are received by command processor control 78 from receiver 66 via lines designated schematically 82 in FIG. 7. Command processor control 78 preferably includes an internal transformer 82, for appropriately stepping down the line voltage provided via lines 80, and a standby battery 84 for use in the event of a failure of public utility service.

Figure 2:
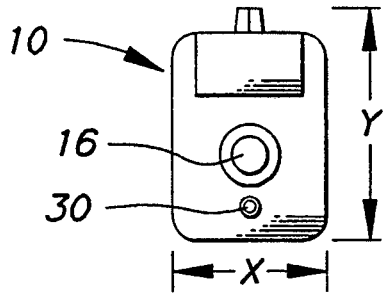
FIG. 2 is a schematic front elevation of a first embodiment of a portable personal distress signal transmitter for wirelessly transmitting distress signals, embodying aspects of the invention.
Figure 3:
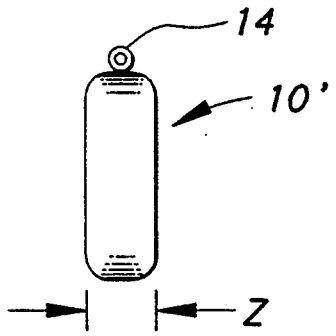
FIG. 3 is a side elevation of the portable personal distress signal transmitter illustrated in FIG. 2.

A typical portable personal distress signal transmitter is illustrated in front elevation in FIG. 2 and in side elevation in FIG. 3. Transmitter 10 includes not only an eye 14 in order that transmitter 10 may be worn about the neck of its custodian, but also an actuator button 16 and an input jack 30 via which information corresponding to a unique identification code for the custodian may be programmed into an EPROM or an EEPROM within transmitter 10. In that regard, as used herein, EPROM denotes an Erasable Programmable Read Only Memory which can desirably only be reprogrammed after first erasing the EPROM with an ultraviolet light source. As used herein, EEPROM denotes an Electrically-Erasable Programmable Read Only Memory which can desirably be reprogrammed with electrical signals.

Personal distress signal transmitter 10 can be equipped with either an EPROM or an EEPROM. Preferably, personal distress signal transmitter 10 is provided as a pendant such as the embodiment illustrated in FIGS. 2 and 3. The pendant form of transmitter 10 may be about 36 millimeters wide, as denoted by dimension X in FIG. 2, about 55 millimeters high, as denoted by dimension Y in FIG. 2 and about 17 millimeters in thickness, as denoted by dimension Z in FIG. 3.

Figure 4:
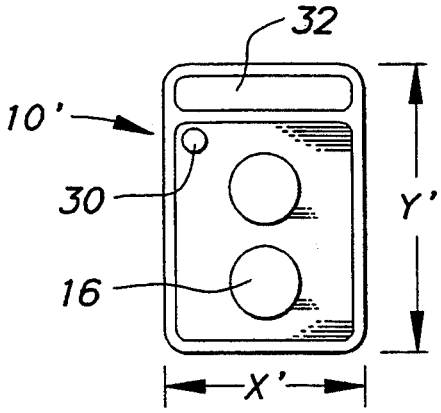
FIG. 4 is a front elevation of a second embodiment of a portable personal distress signal transmitter for wirelessly transmitting distress signals, embodying aspects of the invention.
Figure 5:
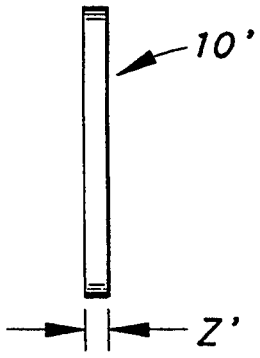
FIG. 5 is a side elevation of the portable personal distress signal transmitter illustrated in FIG. 4.

A second embodiment of a personal distress signal transmitter is designated 10' in FIGS. 4 and 5. In the embodiment illustrated in FIG. 4, personal distress signal transmitter 10' is equipped with an actuator button 16, a jack receptacle 30 and an UV erase window 32 via which ultraviolet light may be provided to the EPROM when it is desired to erase the EPROM. Erasure of the EPROM is necessary preparatory to reprogramming it with information corresponding to the unique identification code for the custodian of personal distress signal transmitter 10 of which the EPROM is a part.

In the embodiment of the personal distress signal transmitter 10' illustrated in FIGS. 4 and 5, transmitter 10' is preferably about 48 millimeters wide, as denoted by dimension by X' in FIG. 4. Transmitter 10' is preferably about 70 millimeters high, as denoted by dimension Y' in FIG. 4 and is about 6.4 millimeters thick, as denoted by dimension Z' in FIG. 5.

Figure 8:
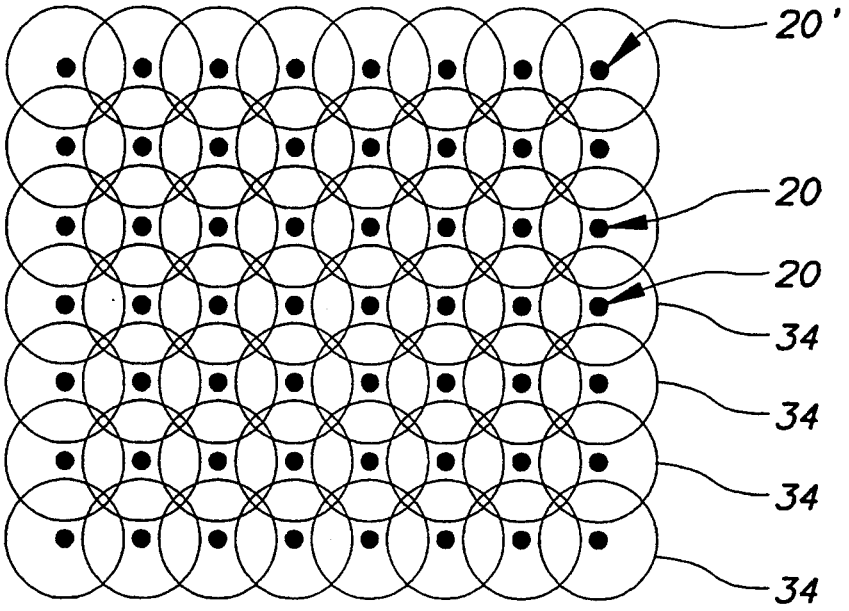
FIG. 8 is a schematic diagram illustrating distribution of personal distress signal detecting stations over a predetermined area, for practice of method aspects of the invention, where the distress signal detecting stations embody aspects of the invention.

In practicing the method of the invention, station means 20 for detecting distress signals from any portable personal distress signal transmitter 10 are preferably positioned in a regular pattern, defined by a rectangular grid, so that detecting stations 20 define the corners of rectangles (which are preferably squares) defining the grid. FIG. 8 depicts a suitable grid.

In FIG. 8, each distress signal detector station 20 is depicted as a black dot. A circle drawn with its center on the black dot denoting distress signal detector station 20 indicates the transmission range of a personal distress signal transmitter 10 portion of the apparatus of the invention. These circles are denoted 34 in FIG. 8.

Distress signal detecting stations 20 are arranged in a manner that the complete predetermined area, within which safety of a plurality of preselected persons is to be monitored, is covered by circles 34 drawn with centers at distress signal detecting stations 20. This ensures that a person having a personal distress signal transmitter 10 may be anywhere within the predetermined area and yet have his or her personal distress signal detected upon transmission by transmitter 10.

As illustrated in FIG. 8, there is substantial overlap among circles 34 within the predetermined area. As a result, if a distress signal is transmitted from any position of overlap of two or more circles 34, the distress signal detector stations 20, located at the centers of circles 34 overlapping the particular area from which the distress signal was transmitted, detect the distress signal and transmit an appropriate relay signal to central monitoring station 28. Upon receiving two or more such relay signals from distress signal detector stations 20, central monitoring station 28 can determine whether the distress signals emanated from a single distress signal transmitter and thereupon perform triangulation computations to delimit the general position within the predetermined area from which the distress signal was transmitted.

Figure 9:
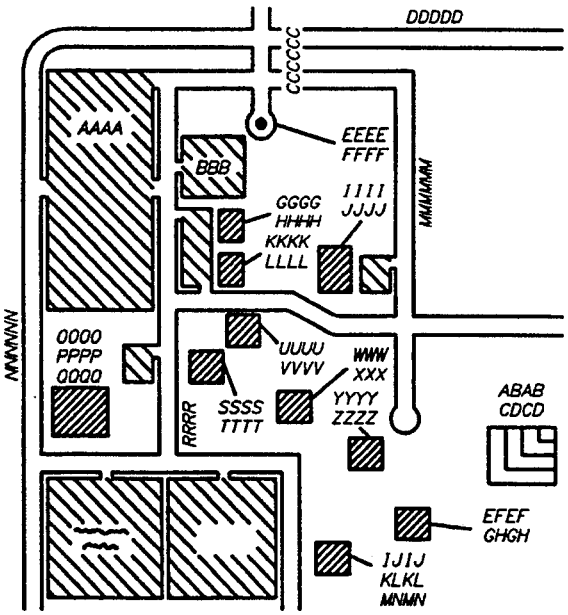
FIG. 9 is a schematic plan view of an exemplary predetermined area within which the invention for monitoring safety of a plurality of persons might be practiced.

FIG. 9 illustrates a plan view of a typical predetermined area, in this case a schematically depicted university campus within which the safety of a plurality of persons, typically students and staff, is to be monitored. Preferably, a map corresponding to FIG. 9 is entered into a computer portion of central monitoring station 28. Locations of distress signal detector stations 20 corresponding generally to the grid illustrated in FIG. 8 are added to the map such as illustrated by FIG. 9.

Each distress signal detector station 20 may have a unique identification code. A map such as illustrated in FIG. 9 and the identification codes associated with distress signal detector stations 20 depicted in the grid of FIG. 8 are the basis of some of the information displayed to relevant security personnel by the central monitoring station. The information is displayed when a distress signal is detected and an appropriate relay signal is sent by one or more of distress signal detecting stations 20 to central monitoring station 28.

Figure 10:
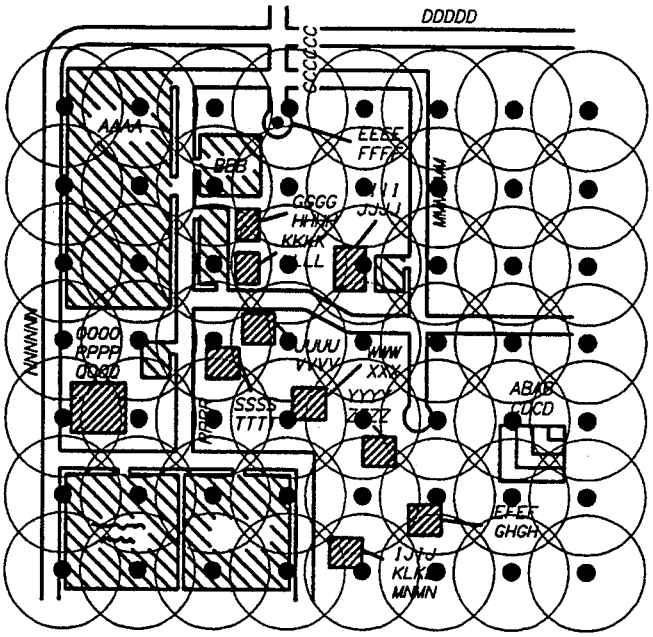
FIG. 10 is a schematic illustration depicting the arrangement of personal distress signal detecting stations shown in FIG. 8 superimposed over the predetermined area of FIG. 9.

Upon receipt of a personal distress signal, central monitoring station 28 identifies which distress signal detector station(s) 20 detected the distress signal and transmitted a relay signal corresponding thereto. Once that detector station 20 is identified, a display is preferably provided on the video monitor illustrated schematically in FIG. 1. The display desirably consists of an enlarged portion of the map of the predetermined area having the detector station grids superimposed thereon as illustrated generally in FIG. 10. The enlarged portion is depicted being displayed on a video terminal in FIG. 11.

Figure 11:
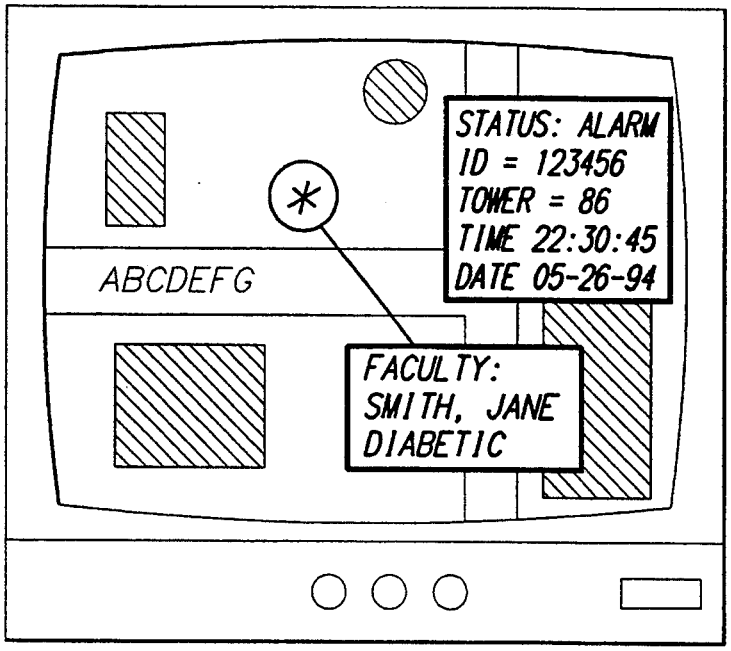
FIG. 11 is a schematic representation of a display on a video monitor portion of a central monitoring station, resulting from transmission of a distress signal, in accordance with the invention.

Desirably included with the enlarged depiction of the portion of the predetermined area shown in FIG. 11 is an identification of the custodian of the portable personal distress signal transmitter from which the distress signal was transmitted. Additionally desirably displayed are (i) identification of the particular distress signal detector station, (ii) the time of the distress signal, (iii) the date the distress signal was transmitted, (iv) whether the signal was an actual distress signal, as opposed to a low battery power signal and (v) particular information associated with the unique identity of the custodian of the personal distress signal transmitter. Also optionally provided is additional information specific to the custodian of the distress signal transmitter; in the case illustrated in FIG. 11, the individual is a faculty men%her and is a diabetic.

Once this information is provided, security personnel watching the display monitor illustrated in FIG. 11 can dispatch appropriate assistance to the individual who transmitted the distress signal.

In situations where more than one distress signal is transmitted at substantially the same time, computer software associated with central monitoring station 28 buffers and windows the additional distress signals, and information associated therewith, behind the distress signal and associated information being displayed on the screen, as illustrated in FIG. 11. When security personnel clear the first distress signal, the next in sequence signal received appears on the screen, preferably again in map form with associated information, as illustrated generally in FIG. 11.

All distress signals received at central monitoring station 28 are desirably recorded in an event database, together with (i) time and date information, (ii) the fact that the distress signal has been acknowledged and (iii) identification of the individual acknowledging the distress signal. This record, defining a log of activity, can be recalled later for evaluation and recordkeeping purposes. The log information is also printed out as such information is recorded; a typical printout of log information for a detected distress signal is illustrated in FIG. 12.

There may optionally be provided transmitters similar to the portable personal distress signal transmitters, for transmitting signals indicative of position of persons carrying those transmitters. Typically, these portable personal position signal transmitters may be carried by security personnel for the premises where security is to be monitored. Equipping security personnel with such portable personal position signal transmitters permits security personnel in the central monitoring station to monitor the whereabouts of security personnel sent in response to a distress signal transmitted by a person in apprehension respecting his or her personal safety. When the predetermined area is large, it may be desirable to track security personnel patrolling throughout the predetermined area so that specific units of security personnel closest to the locale from which the distress signal was transmitted can be sent to respond to the distress signal.

Desirably, the apparatus includes a self-test function which automatically checks the integrity of the apparatus including the relay stations 20 and the central monitoring station 28 on a periodic basis or when commanded by monitoring personnel in central monitoring station 28.

It is within the purview of the invention to provide half-duplex two-way voice contact between the central monitoring station and a person in apprehension of his or her personal safety through the distress signal detector station closest to the person in apprehension of his or her personal safety. Voice compression and decompression technology may be utilized to facilitate such communication between the distress signal detector station and the central monitoring station. Microphones and speakers associated with each distress signal detector station may facilitate voice communication between the person in apprehension of his or her personal security and the particular distress signal detector which, in turn, may communicate with the central monitoring station via airwaves or wire.

While the preferred embodiment of the invention has been described above and alternative embodiments have also been described, the scope of protection to which the invention is believed entitled is defined by the claims and by equivalents thereto which perform substantially the same function in substantially the same way to achieve substantially the same result as set forth in the claims, so long as such substantial equivalents, as defined by a claim literally reciting such substantial equivalent, do not read on the prior art.

I claim the following:

1. A method for monitoring safety of a plurality of persons within a predetermined area, comprising:

a. wirelessly transmitting from a person in apprehension respecting personal safety a distress signal indicative of a preselected identification code unique to such person;

b. monitoring said distress signal by a plurality of detecting stations distributed throughout said predetermined area so that at least one of said detectinq stations is within range of said distress signal throughout said predetermined area;

c. detecting said distress signal by at least one of said detecting stations;

d. sending a relay signal to a central monitoring station from at least one of said detecting stations responsively to detecting said distress signal, said relay signal including:

i. information indicative of said unique code associated with said distress signal; and ii. information indicative of location within said predetermined area from which said relay signal is sent;

e. upon receiving said relay signal at said central monitoring station, determining said unique code associated with said detected distress signal and correlating said unique code with said person in apprehension;

f. correlating said information indicative of location from which said relay signal was sent with position within said predetermined area; and g. providing a sensorially perceptible information display including;

i. identity of said person in apprehension:

ii. membership status and personal information for said person in apprehension; and iii. position within said predetermined area from which said distress signal was transmitted.

2. The method of claim 1 wherein said transmitting further comprises modulating position of pulses of said distress signal to encode information indicative of said unique preselected identification code therein.

3. The method of claim 1 wherein said relay signal is sent wirelessly.

4. The method of claim 1 wherein said distress signal and relay signal are of different frequencies.

5. The method of claim 1 wherein if only one relay signal is received, said correlating step further comprises identifying the location from which said relay signal was sent and if more than one relay signal is received, computing via triangulation techniques the location from which said distress signal was sent to cause said relay signals to be sent to said central monitoring station.

6. The method of claim 1 further comprising sounding an audible alarm at said detecting stations upon detecting said distress signal.

7. The method of claim 1 further comprising lighting the local area proximate said detecting stations upon detecting said distress signal.

8. The method of claim 6 further comprising lighting area proximate said detecting stations upon detecting said distress signals.

9. The method of claim 8 wherein said lighting is intermittent.

10. The method of claim 7 wherein said lighting is intermittent.

11. The method of claim 1 further comprising the steps of:

a. transmitting a battery information signal indicative of low battery power for providing said distress signal;

b. detecting said battery information signal by at least one of said detecting stations; and c. sending an informative signal to said central monitoring station form at least one of said detecting stations, said information signal being indicative of said unique code associated with said low battery power.

12. The method of claim 1 wherein said distress signal is substantially in the 300 Mhz band.

13. The method of claim 12 wherein said distress signal is amplitude modulated to provide said information associated with said identification code which is unique to said person.

14. The method of claim 1 wherein personal information for said person in apprehension comprises medical information relating to said person so that appropriate action may be taken to assist said person.

15. The method of claim 1 further comprising the steps of:

a. monitoring status of a tamper switch located on said detecting stations by said detecting stations;

b. detecting a change of status of said tamper switch by said detecting stations; and c. transmitting a tamper switch status signal to said central monitoring station responsively to a change of status of said tamper switch.

16. The method of claim 1 further comprising the steps of:

a. sending a loop-back test request from said central monitoring station to said detecting stations for checking proper operation of said detecting stations;

b. detecting said loop-back test request by said detecting stations;

c. sending a simulated distress signal and detecting said simulated distress signal by said detecting stations; and d. transmitting a loop-back status message to said central monitoring station by said detecting stations, said loop-back message indicating operation status of said detecting stations.

17. The method of claim 1 further comprising the step of connecting a speaker and microphone to said detecting stations to allow half-duplex voice communication between a person monitoring said central monitoring station and said person in apprehension.

18. The method of claim 1 wherein the step of providing a sensorially perceptible information display comprises displaying a map of the predetermined area for accurately locating said person in apprehension.

19. The method of claim 1 further comprising the steps of downloading a program from said central monitoring station to said detecting station and executing said program by said detecting station.

20. The method of claim 1 further comprising the steps of logging information relating to said relay signal, said information including, time and date when said central monitoring station received said relay signal and identification of person monitoring said central monitoring station and acknowledging said relay signal.

21. The method of claim 1 wherein said transmitting further comprises modulating amplitude of said distress signal to encode information indicative of said unique preselected identification code therein.

22. A method for monitoring safety of a plurality of persons within a predetermined area, comprising:

a. wirelessly transmitting from a person in apprehension respecting personal safety a distress signal indicative of a first preselected identification code unique to such person in apprehension;

b. continuously transmitting from a security person a location signal indicative of a second preselected identification code unique to such security person;

c. monitoring said distress and location signals by a plurality of detecting stations distributed throughout said predetermined area so that at least one of said detecting stations is within range of said distress and location signals throughout said predetermined area;

d. detecting said distress and location signals by at least one of said detecting stations;

e. sending a relay signal to a central monitoring station from at least one of said detecting stations responsively to detecting said distress and location signals, said relay signal including:

i. information indicative of said unique codes associated with said distress and location signals; and ii. information indicative of location within said predetermined area from which said relay signal is sent;

f. upon receiving said relay signal at said central monitoring station, determining said unique codes associated with said detected distress and location signals and correlating said unique codes with said person in apprehension and security person;

g. correlating said information indicative of location from which said relay signal was sent with a position within said predetermined area; and h. providing a sensorially perceptible information display including, identity of said person in apprehension, identity of said security person, membership status and personal information for said person in apprehension, and location within said predetermined area from which said detected distress and location signals were transmitted.

23. A method for monitoring safety of a plurality of persons within a predetermined area, comprising:

a. transmitting from a person in apprehension respecting personal safety a distress signal indicative of a first preselected identification code unique to said person in apprehension;

b. transmitting a battery signal indicative of low battery power for providing said distress signal;

c. continuously transmitting from a security person a location signal indicative of a second preselected identification code unique to said security person;

d. monitoring said distress, battery and location signals by a plurality of detecting stations distributed throughout said predetermined area so that at least one of said detecting stations is within range of said distress, battery and location signals throughout said predetermined area;

e. detecting said distress, battery and location signals by at least one of said detecting stations;

f. activating an alarm at the detecting station responsively to detecting said distress signal;

g. sending a relay signal to a central monitoring station from at least one of said detecting stations responsively to detecting said distress, battery and location signals, said relay signal including:

i. information indicative of said unique codes associated with said distress, battery and location signals; and ii. information indicative of location within said predetermined area from which said relay signal is sent;

h. upon receiving said relay signal at said central monitoring station, determining said unique codes associated with said detected distress, battery and location signals and correlating said unique codes with said person in apprehension, low batter power and security person;

i. correlating said information indicative of location from which said relay signal was sent with a position within said predetermined area; and j. providing a sensorially perceptible information display including, identity of said person in apprehension, low battery power and security person, membership status and personal information for said person in apprehension, and location within said predetermined area from which said location signal was transmitted.

24. Apparatus for monitoring safety of a dynamically changing plurality of preselected personnel within a predetermined area, comprising:

a. a plurality of portable personal distress signal transmitters for wirelessly transmitting distress signals including information corresponding to a unique identification code for a user of each said transmitter, each said personal distress signal transmitter comprising:

i. means for storing information corresponding to said identification codes; and ii. means for activating said transmitter and thereby transmitting said distress signal including said stored information corresponding to said identification code upon a transmitter user becoming in apprehension respective personal safety;

b. a plurality of detecting station for detecting distress signals from any of said portable personal distress signal transmitters and responsively thereto transmitting a relay signal including:

i. information corresponding to said unique identification code associated with said portable personal distress signal transmitter from which said distress signal is received; and ii. information identifying at least one of said detecting stations among said plurality transmitting said relay signal;

c. central monitoring station means for receiving said relay signal from at least one of said detecting stations and providing a sensorially perceptible information display including;

i. location of at least one of said detecting stations transmitting said relay signal;

ii. whether said identification code for which said information was received as a part of said relay signal is for a person currently a member of said plurality;

iii. identification of said person; and iv. personal information pertaining to said person; and d. programmable means for maintaining and dynamically updating said plurality of persons and identification codes uniquely associated therewith.

25. Apparatus of claim 24 wherein said personal distress signal transmitters further comprise:

a. battery means for powering said portable personal distress signal transmitter; and b. means for detecting when said battery means is approaching an unacceptably low level and providing an alarm signal indicative thereof.

26. Apparatus of claim 24 further comprising a plurality of portable personal position signal transmitters for wirelessly periodically transmitting position signals detectable by said detecting stations.

27. Apparatus of claim 24 wherein said stations for detecting said distress signals further comprise means for emitting an audible alarm upon detecting a distress signal.

28. Apparatus of claim 24 wherein said stations for detecting said distress signals further comprise means for illuminating locale proximate said station upon detecting a distress signal.

29. Apparatus of claim 24 wherein said central monitoring station further comprises means for computing via triangulation techniques, upon receipt of a plurality of said relay signals, locale from which said distress signal caused said relay signals to be sent to said central monitoring station.

30. Apparatus of claim 24 wherein said distress signal transmitter transmits in substantially 350 Mhz range

31. Apparatus of claim 24 wherein personal information for said person in apprehension comprises medical information relating to said person so that appropriate action may be taken to assist said person.

32. Apparatus of claim 24 further comprising a tamper switch located on said detecting stations, detecting means for detecting a change of status of said tamper switch and a transmitter for sending said change of status from said detecting stations to said central monitoring station.

33. Apparatus of claim 24 further comprising a transmitter for sending a loop-back test request message to said detecting stations and said detecting stations further comprising a receiver for receiving said message and a transmitter for sending a loop-back status response message indicating operation status of said detecting stations.

34. Apparatus of claim 24 wherein said detecting stations further comprise a speaker and a microphone to allow half-duplex voice communication between a person monitoring said central monitoring station and a person in the vicinity of said detecting stations.

35. Apparatus of claim 24 wherein said central monitoring station further comprises a transmitter for downloading a program to said detecting stations and said detecting stations further comprise a receiver for receiving said program.

36. Apparatus of claim 24 wherein said central monitoring station further comprises a logging means for storing the time and date when said central monitoring station received said relay signal and identification of a person monitoring said central monitoring station.

* * * * *

UNITED STATES PATENT AND TRADEMARK OFFICE

CERTIFICATE OF CORRECTION

PATENT NO. : 5,365,217

DATED : November 15, 1994

INVENTOR(S) : Frank J. Toner

It is certified that error appears in the above-identified patent and that said Letters Patent is hereby corrected as shown below:

On the title page, delete Assignee "Frank J. Toner; Atlantic Coast Alarm, Margate, NJ Signed and Sealed this Tenth Day of October, 1995

*Attest:*

Bruce Lehman

BRUCE LEHMAN

*Attesting Officer*

*Commissioner of Patents and Trademarks*